United States Patent [19]

Flora

[11] 4,153,825

[45] May 8, 1979

[54] ELECTRIC SWITCH AND ACTUATOR FOR AN ANTENNA DRIVE SYSTEM

[75] Inventor: Raymond A. Flora, Dayton, Ohio

[73] Assignee: General Motors Corporation, Detroit, Mich.

[21] Appl. No.: 900,051

[22] Filed: Apr. 26, 1978

[51] Int. Cl.[2] ..... H01Q 1/10

[52] U.S. Cl. ..... 200/47

[58] Field of Search ..... 200/47; 343/903

[56] References Cited

U.S. PATENT DOCUMENTS

| | | | |
|---|---|---|---|
| 3,616,884 | 11/1971 | Balz | 200/47 |
| 3,703,673 | 11/1972 | Balz | 200/47 |
| 3,720,295 | 3/1973 | Balz | 200/47 |
| 3,893,125 | 7/1975 | De Bellomayre | 343/903 |
| 3,931,484 | 1/1976 | Chace | 200/47 |
| 3,959,614 | 5/1976 | Graninger | 200/47 |

*Primary Examiner*—Ro E. Hart

*Attorney, Agent, or Firm*—Donald F. Scherer

[57] ABSTRACT

A dual snap-action electric switch is used in an antenna drive to stop antenna movement when a predetermined resistance to longitudinal movement is encountered. The switch has two actuator arms operated by actuator tabs maintained in spaced relation by a spring. The actuator tabs are movable longitudinally in response to longitudinal movement of an electric motor driven worm shaft to open one or the other of the switches to stop the motor, such as when full extension or retraction of the antenna is reached.

1 Claim, 3 Drawing Figures

ELECTRIC SWITCH AND ACTUATOR FOR AN ANTENNA DRIVE SYSTEM

This invention relates to electric switch actuators and more particularly to dual snap-action switch actuators for use in electrically driven antenna systems.

It is an object of this invention to provide an improved snap-action switch actuator wherein the actuator is responsive to longitudinal movement of an electric motor drive shaft to enforce opening of the switch to discontinue operation of the motor.

It is another object of this invention to provide an improved dual-action switch actuator having a pair of spring-separated actuator tabs responsive to longitudinal movement of an electric motor drive shaft, in one direction or the other, respectively, to operate on respective actuator arms which one or the other of the switch contacts to disconnect the electric motor thereby stopping operation thereof.

A further object of this invention is to provide an improved electric switch actuator for an electric motor operated antenna drive wherein a pair of actuator tabs, secured to a pair of spring-separated members which are moved longitudinally in response to longitudinal movement of the motor drive shaft, operate one or the other of a pair of snap-action electric switches to discontinue operation of the electric motor.

These and other objects and advantages of the present invention will be more apparent from the following description and drawings in which.

Figure 1:
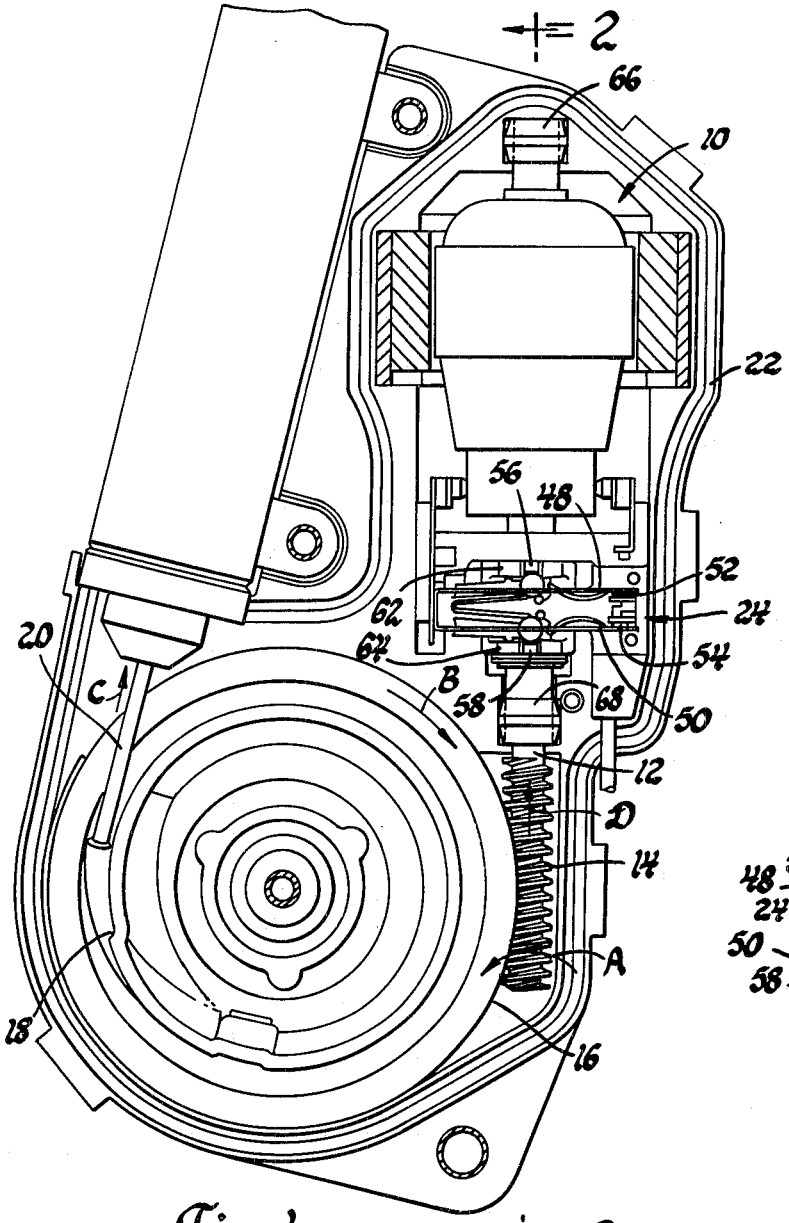
FIG. 1 is an elevational view partly in section of an antenna drive system.

Referring to the drawings, there is seen in FIG. 1 an electric drive motor 10 having a drive shaft 12 which has a worm 14 formed thereon. The worm 14 meshes with a worm gear 16 to drive a cable take-up spool 18 to which is secured an antenna drive cable 20 which is operable to extend and retract a conventional antenna mast. The cable and antenna take-up spool are similar to that shown in U.S. Pat. No. 3,253,799 issued to R. J. Till on May 31, 1966, and assigned to the assignee of the present invention. Reference may be made thereto should a more complete description of a particular antenna drive cable be desired by the reader.

Figure 2:
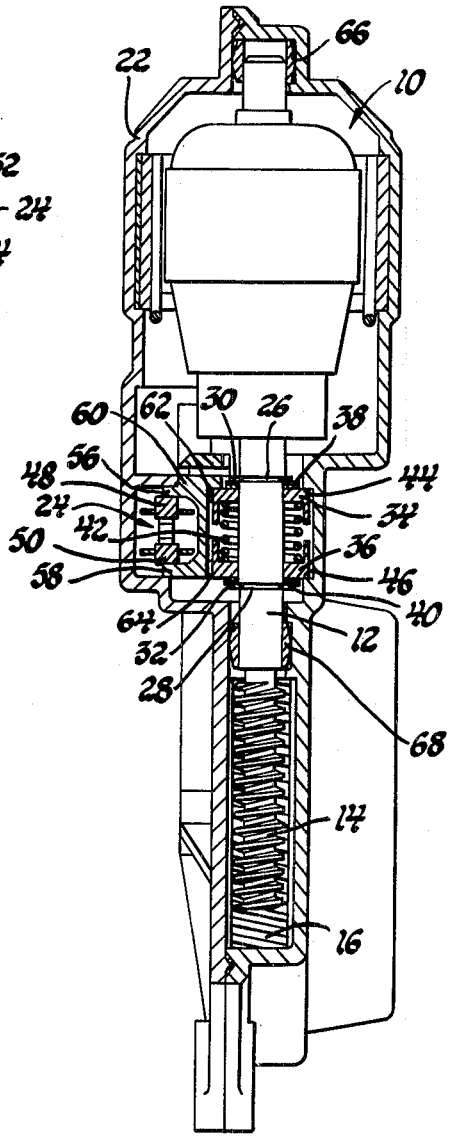
FIG. 2 is a view partly in section taken along line 2—2 of FIG. 1.

The motor and drive cable are enclosed in a housing 22 as are the electrical operating components such as a pair of snap-action switches shown at 24. These snap-action switches 24 may be of any conventional design in which actuator arms are incorporated. As can be seen in FIG. 2, the drive shaft 12 has formed thereon a pair of grooves 26 and 28 in which are secured retainer rings 30 and 32, respectively. Abutting the ring 20 is a spring seat 34 and abutting the snap ring 32 is a spring seat 36. Washers such as those shown on 38 and 40 are disposed between the spring seat 34 and ring 30 and spring seat 36 and ring 32, respectively, to provide bearing surfaces. The spring seats 34 and 36 are urged toward their respective rings 30 and 32 by a coil spring 42, and in the "at rest" position shown, the spring seats 34 and 36 abut shoulders 44 and 46, respectively, formed in the housing 22.

The switch 24 has a pair of actuator arms 48 and 50 having formed thereon switch contacts 52 and 54, respectively. When the switch contacts 52 and 54 are closed, the actuator arms 48 and 50 abut shoulders 56 and 58, respectively, which shoulders 56 and 58 are formed in a housing 60 containing the switch 24. The acutator arm 48, when moved in the direction of the axis of shaft 12, will cause the switch contacts 52 to be opened, and the actuator arm 50, when moved in the direction of the axis of shaft 12, will cause the switch contact 54 to be opened. When the actuating force is removed from arm 48 or 50, the switch contacts 52 and 54 will be closed by the force in the actuator arms 48 and 50. As is well known, the actuator arms 48 or 50 must be moved a small distance before the respective electric contacts therein will snap open.

Figure 3:
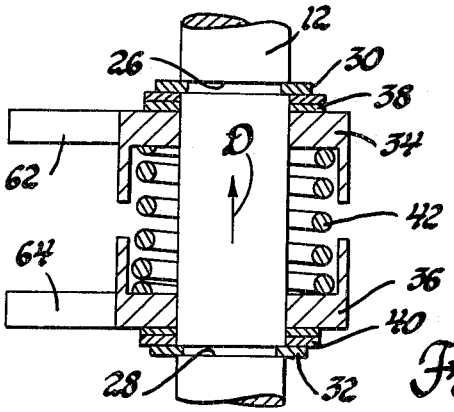
FIG. 3 is an enlarged view of a portion of the switch actuator shown in FIG. 2.

As best seen in FIG. 3, the spring seat 34 has an actuator tab 62 and the spring seat 36 has an actuator tab 64. These actuator tabs 62 and 64 extend through openings, not shown, in the housing 60 to abut the actuator arms 48 and 50, respectively.

During operation of the antenna drive, the drive shaft 12 is driven by the electric motor 10 such that the worm 14 will transmit rotary drive to the worm gear 16 which in turn drives the take-up spool 18 and causes longitudinal movement of the cable 20 out of the housing 22. If the cable 20 should meet a predetermined resistance to longitudinal movement, such as a full extension or retraction of the antenna, or if an obstruction is met by the antenna when being extended or retracted, the drive shaft 12 will move longitudinally due to the interaction between the worm 14 and the worm gear 16.

Assuming the drive shaft 12 is rotated in the left had worm direction of arrow A, as seen in FIG. 1, the worm gear 16 will be rotated in the direction of arrow B resulting in movement of the cable 20 in the direction of the arrow C. This happens to be the extending direction of the antenna. When the antenna reaches full extension, or if an obstruction is met by the antenna, the worm gear 16 will be restrained from further movement such that the action of the worm 14 continuing to rotate will cause the drive shaft 12 to move longitudinally in the direction of arrow D. As seen in FIG. 3, movement of the drive shaft 12 in the direction of arrow D, will cause the snap ring 32 to enforce movement of spring seat 36 in the direction of arrow D, resulting in movement of the actuator tab 64. This movement of actuator tab 64 will cause actuator arm 50 to be deflected thereby opening switch contacts 54 and prevent further operation of the electric motor. Spring seat 34 will remain stationary because of the abutment with shoulder 44.

When it is desired to move the antenna in the opposite direction, the drive shaft 12, and therefore worm 14, will be rotated in the direction opposite to arrow A resulting in rotation of the worm gear 16 in a direction opposite to arrow B which will result in movement of the cable 20 in a direction opposite to arrow C. When the antenna cable 20 has been moved in the direction opposite to arrow C an amount sufficient to cause complete retraction of the antenna, the resistance created will cause stoppage of the rotation of worm gear 16 such that continued rotation of worm 14 will result in longitudinal movement of drive shaft 12 in a direction opposite to arrow D.

As seen in FIG. 3, movement of shaft 12 in the direction opposite to arrow D will be transmitted through snap ring 30 to spring seat 34 to which actuator tab 62 is integral with. Movement of actuator tab 62 will cause deflection of spring actuator arm 48 resulting in the opening of switch contacts 52 which will stop further operation of the electric motor. Spring seat 36 will remain stationary through the abutment with shoulder 46. It should be appreciated that upon reversal of the drive shaft 12, the first or initial movement of the drive shaft will be longitudinal due to the forces stored within the system, such as those stored in coil spring 42, such that the spring contacts which had been previously opened by actuator tab 62 or 64 will be permitted to close. It is also well-known in the use of reversible motors for antenna systems that one switch contact is closed for upward movement or extension of the antenna, and the other switch contact is closed for downward movement or retraction of the antenna. Thus, on reversing the system, such as from a fully extended to fully retracted position, spring contact 54 can be originally opened as long as spring contacts 52 are closed since electrical power flow to the motor 10 is through contacts 52 during retraction. Thus, the presence of open switch contacts 54 is not detrimental to the reversal of the drive system. The same is true on a reversal of the drive system from fully retracted to fully extended wherein initially switch contacts 52 are open while switch contacts 54 are closed. The amount of resistance to longitudinal movement of shaft 12, which must be overcome for switch contact operation will occur, is determined by the force stored in spring 42. Thus, it is seen that, by changing the force in spring 42, various levels of resistance to cable movement can be used in any particular system depending on the resistance level desired by the designer.

The drive shaft 12 is supported for rotation within a pair of bearings such as 66 and 68 which maintain the shaft 12 aligned on its longitudinal axis and permit longitudinal movement of the shaft relative to the housing 22. The bearings 66 and 68 are preferably spherical at their outer surface to accommodate self-aligning of the shaft 12.

Obviously, many modifications and variations are possible in light of the above teachings. It is, therefore, to be understood that within the scope of the appended claims, the invention may be practiced otherwise than as specifically described.

The embodiments of the invention in which an exclusive property or priviledge is claimed are defined as follows:

1. An electric switch and actuator assembly for an antenna drive having an electric motor driven worm shaft subject to longitudinal movement when the worm gear driven thereby encounters a predetermined resistance, said switch and actuator assembly comprising; a snap-action switch having first and second actuator arms, each arm having a switch contact thereon; first and second spring seats mounted on said worm shaft; retaining means secured to said worm shaft adjacent each of said spring seats for enforcing longitudinal movement of the first spring seat in one direction and the second spring seat in the other direction; a switch actuator tab on each of said first and second spring seats adjacent said first and second actuator arms respectively to actuate said first acutator arm when said worm shaft moves longitudinally in said one direction and to actuate said second actuator arm when said worm shaft moves longitudinally in said other direction; stop means abutting each of said first and second spring seats for preventing longitudinal movement of said first spring seat in said other direction and said second spring seat in said one direction; and spring means disposed between said spring seats urging each of said spring seats toward abutment with said respective stop means and said retaining means, and for imposing a predetermined longitudinal centering force on said worm shaft which force must be overcome before longitudinal movement of said worm shaft occurs.

* * * * *

UNITED STATES PATENT AND TRADEMARK OFFICE

Certificate

Patent No. 4,153,825 Patented May 8, 1979

RAYMOND A. FLORA

Application having been made by Raymond A. Flora, the inventor named in the patent above identified, and General Motors Corp., Detroit, Mich., the assignee, for the issuance of a certificate under the provisions of Title 35, Section 256, of the United States Code, adding the name of Ralph W. Edwards as a joint inventor, and a showing and proof of facts satisfying the requirements of the said section having been submitted, it is this 12th day of July 1983, certified that the name of the said Ralph W. Edwards is hereby added to the said patent as a joint inventor with the said Raymond A. Flora.

Fred W. Sherling,
*Associate Solicitor*